US006675883B1

(12) United States Patent
De Keuster et al.

(10) Patent No.: US 6,675,883 B1
(45) Date of Patent: Jan. 13, 2004

(54) MANIFOLD FOR HEAT EXCHANGER

(75) Inventors: Richard Mark De Keuster, Racine, WI (US); Noorulhaq Pandit, Schaumburg, IL (US); Donald Scott Lightner, Franksville, WI (US); Lawrence William Gabbey, Racine, WI (US); Gregory Mark DaPra, Racine, WI (US); Jeffrey Alan Logic, Racine, WI (US); Thomas M. Shields, Racine, WI (US); Richard J. Trapp, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/190,966

(22) Filed: Jul. 8, 2002

(51) Int. Cl.[7] ..... F28F 9/02
(52) U.S. Cl. ..... 165/173; 165/175; 29/890.032
(58) Field of Search ..... 165/173, 175, 165/153; 228/183; 29/890.052

(56) References Cited

U.S. PATENT DOCUMENTS

| | | | | | |
|---|---|---|---|---|---|
| 1,028,829 | A | | 6/1912 | Reuterdahl | |
| 2,215,318 | A | | 9/1940 | Bristol | |
| 3,433,270 | A | | 3/1969 | Fischer et al. | |
| 3,866,675 | A | | 2/1975 | Bardon et al. | |
| 4,165,944 | A | | 8/1979 | Sunasky | |
| 4,649,628 | A | * | 3/1987 | Allemandou | 165/148 |
| 4,651,815 | A | * | 3/1987 | Logic et al. | 165/76 |
| 4,802,716 | A | | 2/1989 | Rö ck et al. | |
| 4,899,815 | A | * | 2/1990 | Bosch et al. | 165/173 |
| 4,917,180 | A | | 4/1990 | Wolf et al. | |
| 4,971,145 | A | | 11/1990 | Lyon | |
| 5,107,926 | A | | 4/1992 | Calleson | |
| 5,125,454 | A | | 6/1992 | Creamer et al. | |
| 5,186,246 | A | | 2/1993 | Halstead | |
| 5,195,579 | A | | 3/1993 | Buchanan | |
| 5,195,582 | A | | 3/1993 | Haase | |
| 5,207,738 | A | | 5/1993 | Dey | |
| 5,236,044 | A | | 8/1993 | Nagasaka et al. | |
| 5,251,692 | A | | 10/1993 | Haussmann | |
| 5,311,933 | A | * | 5/1994 | Lee | 165/149 |
| 5,329,995 | A | | 7/1994 | Dey et al. | |
| 5,445,219 | A | | 8/1995 | Hutto et al. | |
| 5,489,162 | A | | 2/1996 | LoCicero et al. | |
| 5,501,271 | A | | 3/1996 | Wijkstrom | |
| 5,605,191 | A | | 2/1997 | Eto et al. | |
| 5,678,628 | A | | 10/1997 | Aki et al. | |
| 5,794,692 | A | | 8/1998 | Voss et al. | |
| 5,816,316 | A | | 10/1998 | Hoffnung | |
| 5,816,321 | A | | 10/1998 | Wijkstrom | |
| 5,836,384 | A | | 11/1998 | Wijkstrom et al. | |
| 5,845,705 | A | * | 12/1998 | Vinh et al. | 165/173 |
| 5,904,206 | A | | 5/1999 | Kroetsch | |
| 6,035,931 | A | | 3/2000 | Kado et al. | |
| 6,173,765 | B1 | * | 1/2001 | Uchikawa et al. | 165/173 |
| 6,179,050 | B1 | | 1/2001 | Dey et al. | |
| 6,250,381 | B1 | | 6/2001 | Nishishita | |
| 6,283,200 | B1 | * | 9/2001 | Sugimoto et al. | 165/173 |
| 6,357,521 | B1 | * | 3/2002 | Sugimoto et al. | 165/173 |
| 2001/0017201 | A1 | * | 8/2001 | Avequin et al. | 165/173 |

FOREIGN PATENT DOCUMENTS

| | | | | |
|---|---|---|---|---|
| DE | 003222300 A1 | * | 12/1983 | 165/173 |
| JP | 10-132485 | | 5/1998 | |
| JP | 10-132490 | | 5/1998 | |

* cited by examiner

*Primary Examiner*—Terrell L. McKinnon
(74) *Attorney, Agent, or Firm*—Wood, Phillips, Katz, Clark & Mortimer

(57) ABSTRACT

An elongate manifold construction (10) having an longitudinal axis (20) is provided for use in a heat exchanger (12) having a plurality of tubes (14). The manifold construction (10) includes an elongated tank piece (3 2) and an elongated header piece (34). A plurality of embossed beads (48) having openings (50) therein that are engaged by tabs (52) spaced along the longitudinal axis (20) to maintain the tank and header pieces (32, 34) in proper alignment with each other so as to obtain a suitable bond joint therebetween during a bonding operation.

29 Claims, 7 Drawing Sheets

MANIFOLD FOR HEAT EXCHANGER

FIELD OF THE INVENTION

This invention relates to manifolds for heat exchangers, and more particularly to manifolds that are a multi-piece fabrication with one of the pieces being a header piece and another of the pieces being a tank piece.

BACKGROUND OF THE INVENTION

Heat exchanger manifolds that are multi-piece fabrications with one piece being a tank piece and another piece being a header piece are well known. One problem associated with such multi-piece manifolds is maintaining the longitudinal edges of the tank and header pieces in a proper orientation with respect to each other when the two pieces are bonded together so as to form a fluid-tight bond. This problem can occur for many types of bonding operations, particularly for brazing operations which require accurate location between the mating surfaces in order to form a suitable braze joint. There have been many past attempts to address this problem by providing features on the header and tank pieces that engage each other so as to locate the header and tank pieces relative to each other during the bonding operation. While at least some of these past attempts may have been suitable for their intended purpose, there is always room for improvement.

SUMMARY OF THE INVENTION

It is the principal object of this invention to provide a new and improved manifold construction for a heat exchanger.

This object is achieved in an elongated manifold construction having a longitudinal axis for heat exchanger having a plurality of tubes extending from the manifold. The manifold includes an elongated tank piece and an elongated header piece. The elongated tank piece includes a pair of spaced longitudinally extending tank edges and a tank wall extending from one of the tank edges to the other to define a cross-sectional shape for the tank piece transverse to the longitudinal axis. The tank edges face a common direction. The elongated header piece includes a pair of spaced longitudinally extending header edges and a header wall extending from one of the header edges to the other to define a cross-sectional shape for the header piece transverse to the longitudinal axis. The header edges face a direction opposite the common direction. At least one of the tank and header pieces further includes at least two embossed beads spaced along the longitudinal axis in the wall adjacent the edges of the at least one of the tank and header pieces. Each embossed bead has a terminal end spaced from one of the edges of the at least one of the tank and header pieces and facing the other of the tank and header pieces. Each of the terminal ends has an opening therein. At least one of the tank and header pieces further includes a plurality of tabs spaced along the longitudinal axis in each of the edges of the at least one of the tank and header pieces and extending toward the other of the tank and header pieces to engage in the openings in the terminal ends of the embossed beads.

In one form, the embossed beads are in the tank wall and the tabs are in the header edges.

In one aspect, the embossed beads are in the header wall and the tabs are in the tank edges.

According to one form, at least one of the embossed beads includes a pair of terminal ends, with one of the pair of terminal ends being the terminal end with the opening and the other of the pair of terminal ends located adjacent the same edge as the terminal end with the opening.

In one form, at least one of the embossed beads includes a pair of terminal ends, with one of the pair of terminal ends located adjacent one of the edges of the at least one of the tank and header pieces and the other of the pair of terminal ends located adjacent the other of the edges of the at least one of the tank and header pieces. The at least one of the embossed beads extends across the wall from one of the pair of terminal ends to the other of the pair of terminal ends. Each of the pair of terminal ends has one of the openings receiving one of the tabs.

In accordance with one aspect of the invention, an elongated manifold construction having a longitudinal axis is provided for a heat exchanger having a plurality of parallel tubes extending from the manifold. The manifold construction includes an elongated tank piece and an elongated header piece. The tank piece has a back wall and two tank side walls extending from each side of the back wall to define a U-shaped cross-section transverse to the longitudinal axis. The tank piece further including at least two embossed beads spaced along the longitudinal axis. Each embossed bead has a pair of terminal ends and extends across the back wall and partially down each of the tank side walls to each of the terminal ends. Each of the terminal ends has an opening formed therein. The elongated header piece has a tube receiving wall and two header side walls extending from each side of the tube receiving wall to define a U-shaped cross-section transverse to the longitudinal axis. Each of the header side walls has a plurality of tabs spaced along the longitudinal axis and extending away from the tube receiving wall to engage in the openings in the tank piece.

Other objectives and advantages will become apparent from the specification, including the appended claims and drawings.

DETAILED DESCRIPTION OF THE PREFERRED EMBODIMENTS

Figure 1:
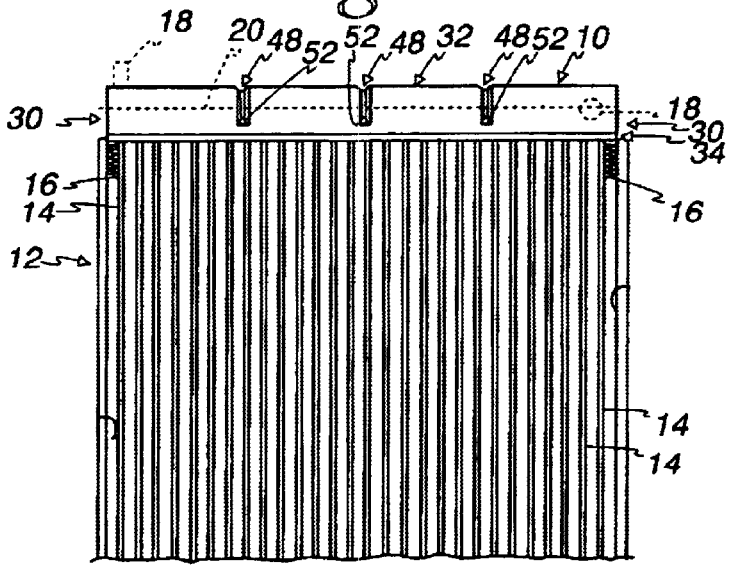
FIG. 1 is a front elevation of a heat exchanger employing manifold constructions embodying the present invention.

A multi-piece manifold construction 10 embodying the present invention is shown in FIG. 1 in connection with a heat exchanger 12 having a plurality of parallel tubes 14 extending therefrom with serpentine fins 16 extending between and in heat exchange relation with the tubes. Depending on the configuration of the heat exchanger 12, one or more fluid ports, shown diagrammatically at 18, may be provided in the manifold construction 10 to serve as inlets/or outlets for the working fluid of the heat exchanger which is distributed to and/or received from the tubes 14 by the manifold construction 10. The manifold construction 10 extends along a longitudinal axis 20.

It should be understood that, while the manifold construction 10 is shown in connection with a particular form of heat exchanger 12 in FIG. 1, the manifold construction 10 may be desirably utilized in many types of heat exchangers and that no limitation to the particular heat exchanger 12 shown in FIG. I is intended, unless expressly stated in the claims. For example, while the heat exchanger 12 shown in FIG. I utilizes flat tubes 14 and serpentine fins 16, if may be desirable in some applications to employ the manifold construction 10 in a heat exchanger having round tubes and/or plate fins. By way of further example, while the heat exchanger 12 shown in FIG. I is oriented so that the longitudinal axis 20 extends in the horizontal direction, it may be desirable to employ the manifold construction 10 in a heat exchanger wherein the longitudinal axis 20 extends in a direction other than horizontal, such as a diagonal direction or a vertical direction.

Figure 2:
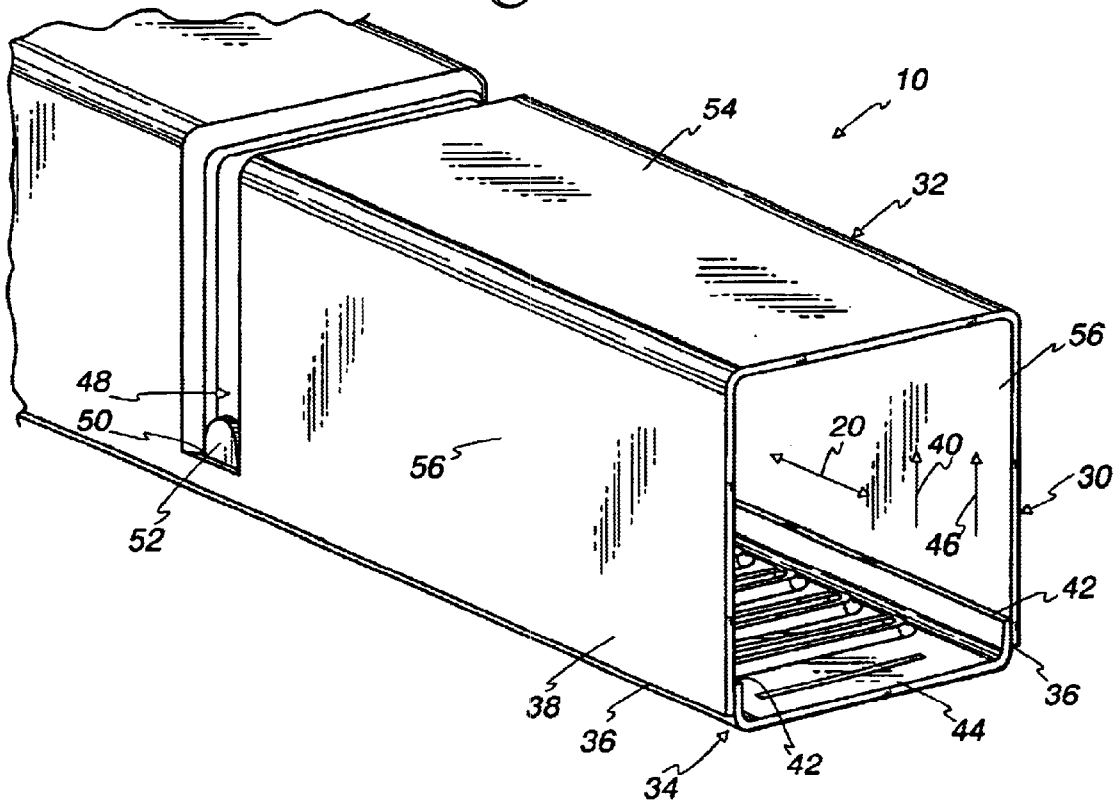
FIG. 2 is a partial perspective view of one of the manifold constructions shown in FIG. 1.

FIG. 2 shows a perspective view of a portion of the manifold construction 10. The manifold construction 10 includes a pair of spaced ends 30 (only one shown in FIG. 2) each of which will be closed by an end piece or cap (not shown) in the final manifold assembly. Such end pieces or cap are configured to engage and be sealingly bonded to the remainder of the manifold construction 10 at each of the ends 30. Because there are many possible constructions for such end pieces and because the end pieces do not form part of the invention and are not critical to an understanding of the invention, further discussion of the end pieces will not be provided herein.

As seen in FIGS. 1 and 2, the manifold construction 10 includes an elongated tank piece 32 and an elongated header piece 34. The tank piece 32 includes a pair of spaced, longitudinally extending tank edges 36 and a tank wall 38 extending from one of the tank edges 36 to the other of the tank edges 36 to define a cross-sectional shape for the tank piece transverse to the longitudinal axis 20, with the tank edges 36 facing a common direction indicated by arrow 40. The header piece 34 includes a pair of spaced, longitudinally extending header edges 42 and a header wall 44 extending from one of the header edges 42 to the other header edge 42 to define a cross-sectional shape for the header piece 34 transverse to the longitudinal axis 20, with the header edges 42 facing a direction indicated by arrow 46 opposite to the direction indicated by the arrow 40. In the illustrated embodiment, the directions indicated by the arrows 40 and 46 are perpendicular to the longitudinal axis 20. As will be explained in more detail below, a plurality of embossed beads 48 having openings 50 therein that are engaged by tabs 52 (only one each of the embossed beads 48, openings 50, and tabs 52 being shown in FIG. 2) are spaced along the longitudinal axis 20 to maintain the tank and header pieces 32, 34 in proper alignment with each other so as to obtain a suitable bond joint therebetween during a bonding operation for the manifold construction 10.

Figure 4:
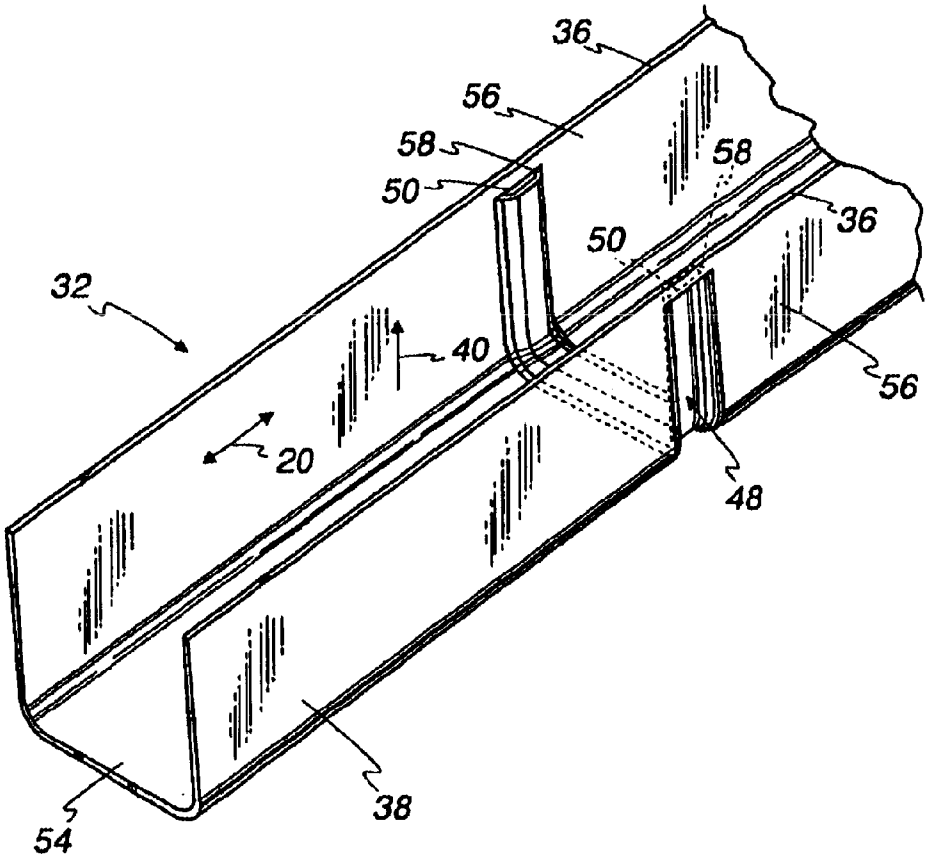
FIG. 4 is a rotated, perspective view of a tank piece of the manifold construction shown in FIG. 2.
Figure 3:
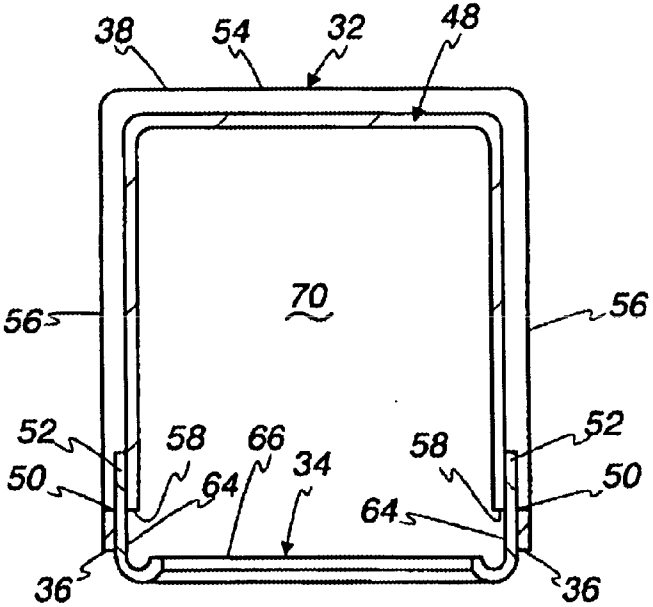
FIG. 3 is a section view of the manifold construction in FIG. 2 taken along line 3—3 in FIG. 2.

As best seen in FIGS. 2–4, the wall 38 of the tank piece 32 in the illustrated embodiment includes a back wall 54 and two tank side walls 56 extending from each side of the back wall 54 to define a U-shaped cross-section transverse to the longitudinal axis 20. As seen in FIG. 4, the tank piece 32 includes the embossed beads 48, with each embossed bead 48 having a pair of terminal ends 58, each located adjacent one of the tank edges 36 and facing the header piece 34 in the direction 40. In the embodiments shown in FIGS. 2–5, each of the embossed beads 48 extends transverse to the axis 20 across the back wall 54 and partially down each of the tank side walls 56 to the terminal ends 58. As best seen in FIGS. 3 and 4, each of the terminal ends 58 has one of the openings 50 formed therein. In the illustrated embodiment, the openings 50 are provided in the form of elongated slots that extend in the longitudinal direction 20. It wall be appreciated that in addition to providing the structure for receiving the tabs 52, the embossed beads 48 shown in FIGS. 2–5 can provide additional stiffness to the tank piece 32 by acting as structural ribs.

Figure 6:
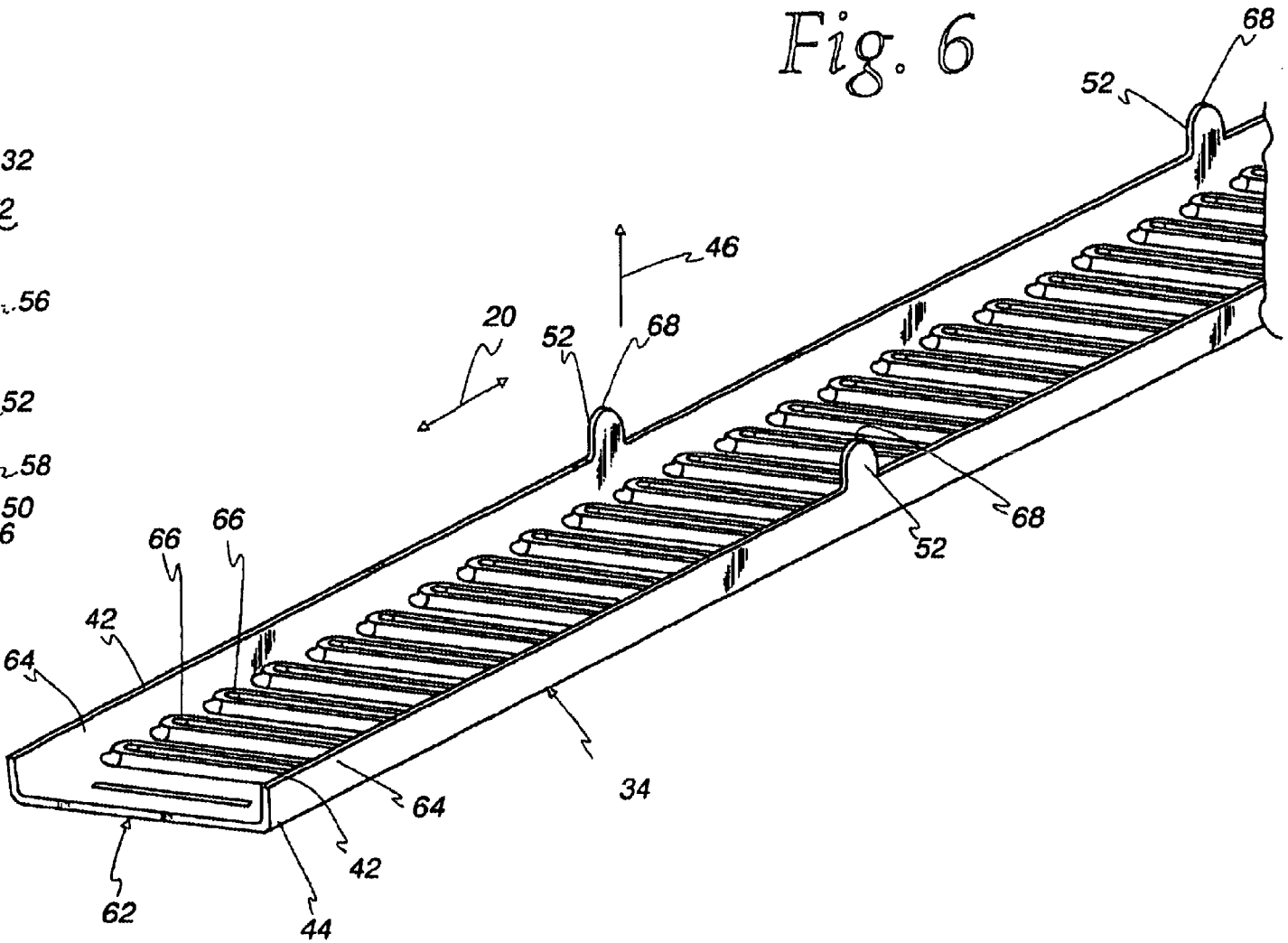
FIG. 6 is a perspective view of a header piece of the manifold construction shown in FIG. 2.

As best seen in FIGS. 3 and 6, in the illustrated embodiment, the header wall 44 includes a tube receiving wall 62 and two header side walls 64 extending from each side of the tube receiving wall 62 to define a U-shaped cross-section transverse to the longitudinal axis 20. It should be appreciated that while the illustrated embodiments of the tank and header pieces 32, 34 are shown as having U-shaped cross-sections, it may be desirable in some applications for one or both of the pieces 32, 34 to have a cross-sectional shape other than U-shaped. For example, in some high pressure applications, it may be desirable for one or both of the pieces 32, 34 to have a semicircular or oval shape.

The tube receiving wall 62 includes a plurality of embossed, flanged tube openings 66, the details of which wall be highly dependent upon the particular type of heat exchanger with which the manifold construction 10 is employed including the type of tubes used in the heat exchanger, the working fluid of the heat exchanger, and the operating pressures of the heat exchanger. Accordingly, because the header piece 34 can employ any type of tube opening 66 that is suitable for the particular heat exchanger in which the manifold construction 10 is employed and because there are large number of known configurations for such openings, the openings 66 will not be described further herein. The side walls 64 include a plurality of the tabs 52 spaced along the longitudinal axis 20 in the header edges 42 of the illustrated embodiment extending toward the tank piece 32 in the direction 46. In the illustrated embodiment, the tabs 52 have a rectangular cross-section that substantially conforms to the shape of the openings 50. Each of the tabs 52 is fully inserted into the corresponding opening 50 so that the header edges 42 adjacent either side of the tabs 52 are seated against the terminal end 58 of the embossed bead 48. Further, in the illustrated embodiment, each of the tabs 52 has a rounded tip 68 which can serve to guide the tabs 52 into their associated openings 50 during assembly of the header and tank pieces 32 and 34.

It should be understood that there are many possible shapes for the embossed beads 48, the openings 50, and the tabs 52. Preferably, the openings 50 somewhat conform to the cross-sectional shape of the embossed beads 48, and the crosssectional shapes of the tabs 52 will be somewhat conforming to the shape of the openings 50. While this is preferred, there may be some applications in which it is desirable for the openings 50 not to conform to the cross-sectional shape of the embossed beads 48 and/or for the cross-sectional shape of the tabs 52 not to conform to the openings 50. Additionally, while it is preferred that the tabs 52 include a guide feature on the end of the tabs 52 to assist in assembling the tabs 52 into the openings 50, there may be some applications where such a feature is not desirable. With respect to such a guide feature on the ends of the tabs 52, the rounded tips 68 are only representative of one of many possible options that could be employed as a guide feature for the tabs 52.

Preferably, the relative spacing of the tank edges 36 and the header edges 42 will provide for a relatively close conforming fit between the tank wall 38 and the header wall 44 adjacent the edges 36 and 42 so as to provide an appropriate joint for the bonding operation, which can be any suitable bonding method such as epoxy bonding, but will typically be brazing. The closeness of such a conforming fit will be highly dependent upon the particular bonding operation selected for the manifold construction 10, and in some manifold constructions 10 a closely conforming fit between the walls 38 and 44 adjacent the edges 36 and 42 may not be required.

Figure 5:
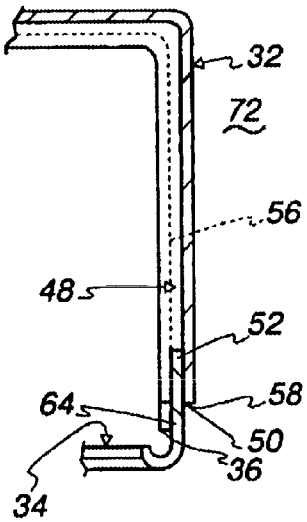
FIG. 5 is a view similar to FIG. 3 but showing an alternate embodiment of the manifold construction shown in FIGS. 2–4.

While the embodiment of the tank piece 32 shown in FIGS. 2, 3 and 4 are shown with the embossed beads 48 protruding into an interior volume 70 of the manifold construction 10, it may be desirable in some applications for the embossed beads 48 to protrude outwardly into an exterior space 72 surrounding the manifold construction 10 as shown in FIG. 5 where the tank piece 32 includes an outwardly protruding embossed bead 48 that in all other aspects is identical to the embossed beads 48 shown in FIGS. 2–4. With respect to the embodiment shown in FIG. 5, it should be understood that the spacing between the tank edges 36 are such that the tank side walls 56 fit within the header side walls 64, as opposed to the configuration shown in FIG. 3 wherein the spacing of the tank edges 36 are such that the header side walls 64 fit within the tank side walls 56.

Figure 7:
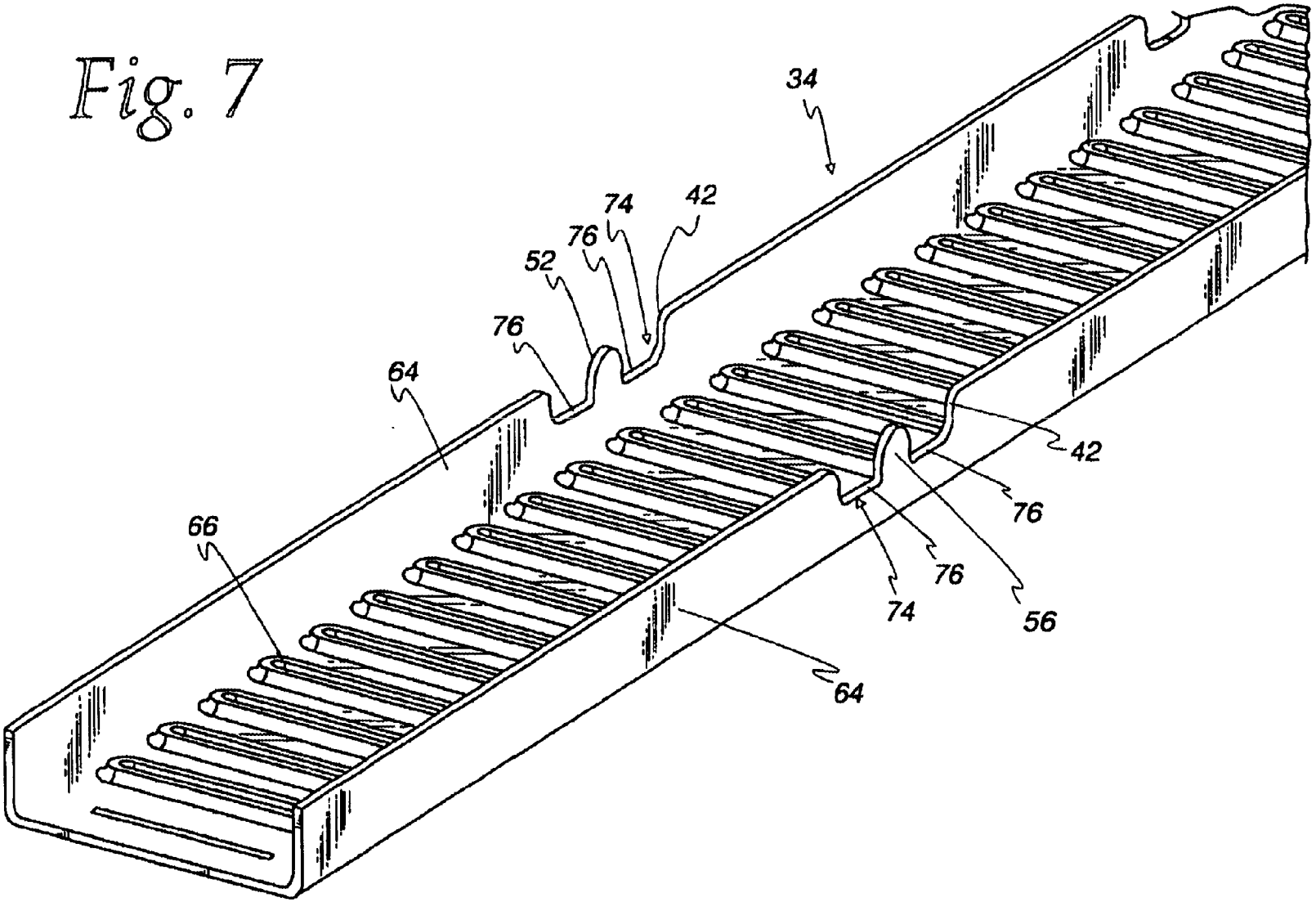
FIG. 7 is a perspective view showing an alternate embodiment of the header piece shown in FIG. 6.

FIG. 7 illustrates an alternate embodiment for the header piece 34 which is identical to the header piece 34 shown in FIG. 6, except for the side walls 64 which extend further from the tube receiving wall 62 than the side walls 64 shown in FIG. 6 and which include recesses 74, with the tabs 52 located within the recesses 74. The recesses 74 are configured to provide clearance between the header edges 42 and the sides of the embossed beads 48 so that the tabs 52 can be fully inserted into the openings 50 and the bottoms 76 of the recesses 74 can be seated against the terminal ends 58 of the embossed beads 48.

Figure 8:
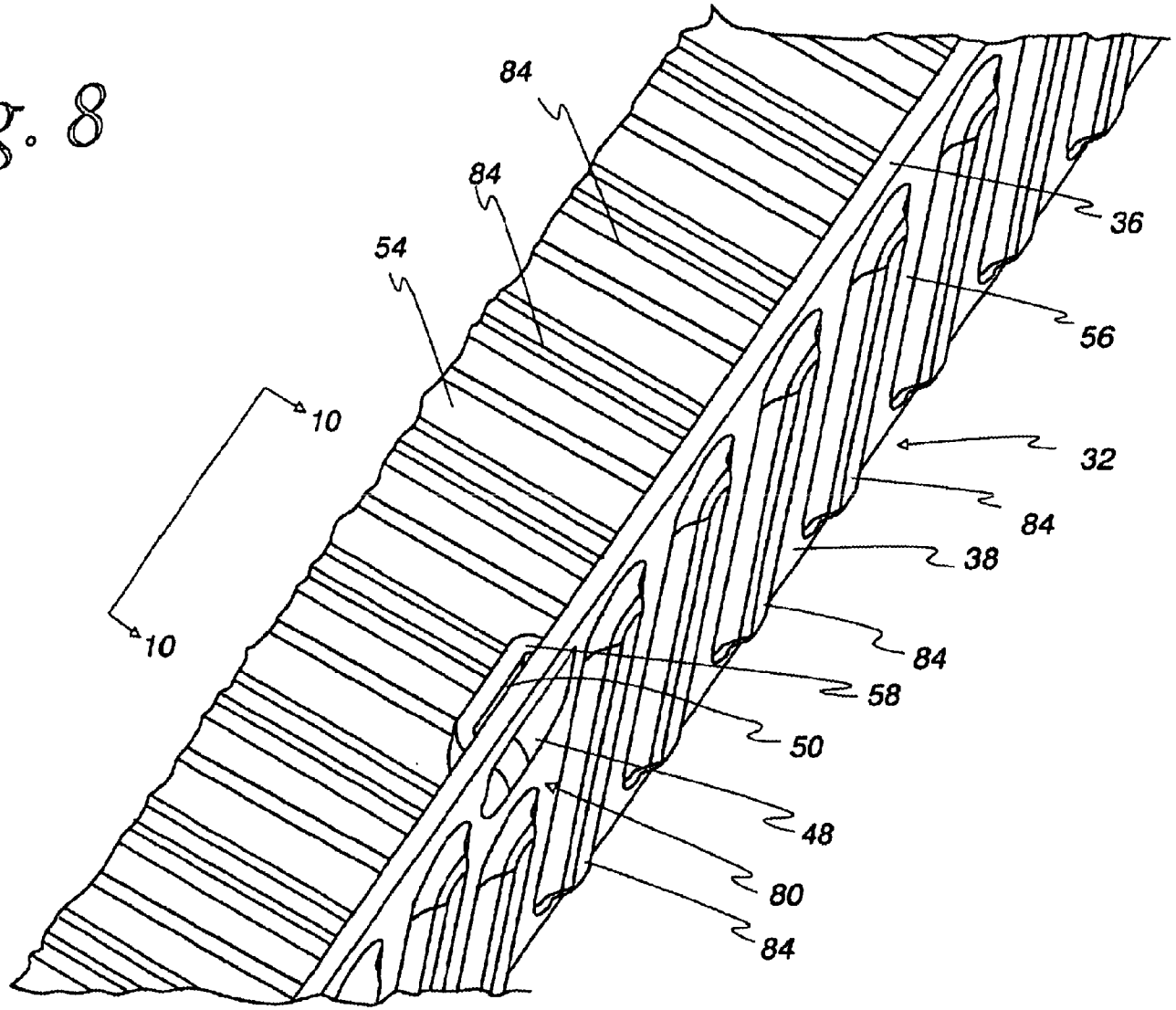
FIG. 8 is a perspective view showing another embodiment of the tank pieces shown in FIGS. 2–5.
Figures 9, 10:
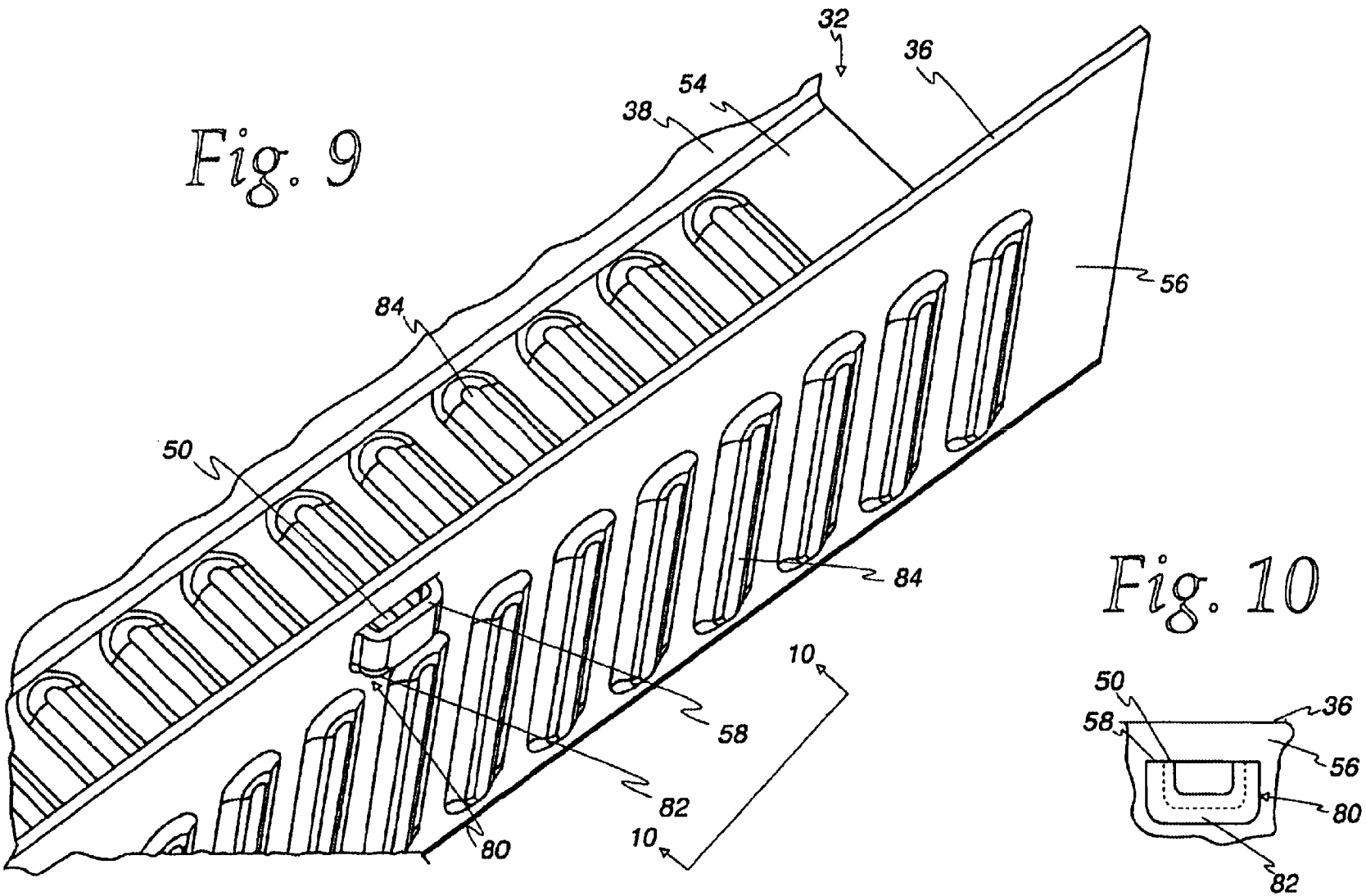
FIG. 9 is a perspective view showing yet another embodiment of the tank pieces shown in FIGS. 2–5 and 8.
FIG. 10 is a partial view of an embossed bead shown in both FIGS. 8 and, 9 taken from lines 10—10 in FIGS. 8 and 9.

FIG. 8 shows and alternate embodiment for the tank piece 32 and the embossed beads 48. In this embodiment, the embossed beads 48 are provided in the form of pockets 80 that extend only partially along the side wall 56 transverse to the longitudinal axis 20. More specifically, as best seen in FIG. 10, the pocket 80 includes a terminal end 82 that is spaced from the terminal end 58 but is located on the same side wall 56 adjacent the same tank edge 36 as the terminal end 58. Preferably, as best seen in FIG. 10, the terminal end 82 is free of any openings (i.e. closed), which can serve to minimize the potential leak paths in the manifold construction 10. However, it may be desirable in some applications for an opening to be provided in the terminal ends 82. FIG. 9 shows an embodiment of the tank piece 32 wherein the pocket 80 protrudes outwardly into the exterior space 72, rather than protruding into the interior volume 70 as shown in FIG. 8.

Both embodiments of the header piece 34 shown in FIGS. 6 and 7 are compatible with the alternate embodiments of the tank piece 32 shown in FIGS. 2–5 and 9–10.

An optional feature of the tank pieces 32 shown in FIGS. 8 and 9 is the inclusion of embossed stiffening ribs 84 that extend along the wall 38 transverse to the longitudinal axis 20. It may be desirable in some applications to include the ribs 84 if additional stiffness is required in the walls 38.

Figure 12:
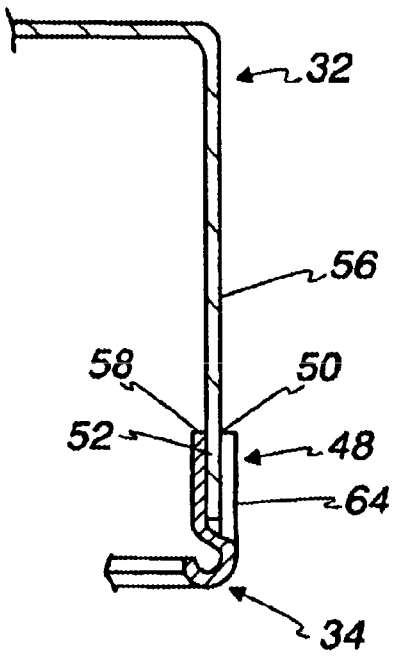
FIGS. 11 and 12 are section views similar to FIGS. 2 and 5, but show two additional embodiments.
Figure 11:
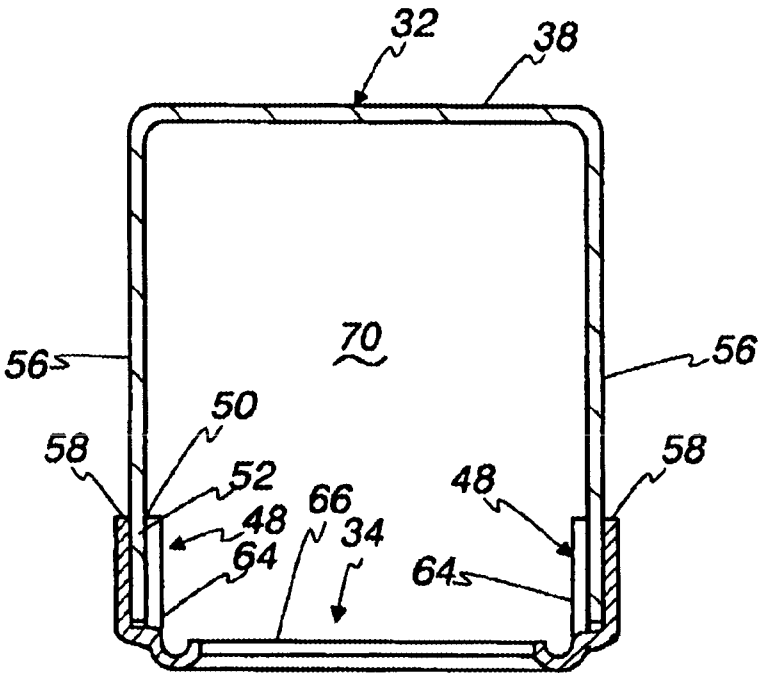

While the illustrated embodiments in FIGS. 1–10 show the embossed beads 48, 80 being formed on the tank piece 32 and the tabs 52 being formed on the header piece 34, it may be desirable in some applications for the tabs 52 to be formed on the tank piece 32 and the embossed beads 48, 80 to be formed on the header piece 34, either protruding outwardly or protruding inwardly, as shown in FIGS. 11 and 12, respectively. In this regard, it may also be desirable to provide the wall 38 of the tank piece 32 with the recesses 74 as shown in FIG. 7.

The precise spacing and sizing of the embossed beads 48, 80, openings 60, and tabs 52 will be highly dependent upon the parameters of the particular application for the manifold construction 10, such as for example, the materials selected for the header and tank pieces 32, 34, the volume requirements for the manifold construction 10, the cross-sectional shapes desired for the header and tank pieces 32, 34, and the type of bonding operation selected for the manifold construction 10. Accordingly, it should be understood that the particular sizing and spacing shown for these components in the drawings is for purposes of illustration and there is no intention to limit the claims thereto, unless expressly stated in the claims.

It should be appreciated that the disclosed embossed beads 48, 80 and tabs 52 can assist in the assembly of the tank and header pieces 32, 34 by conveniently locating the portions of the walls 38 and 44 adjacent the edges 36 and 42 in their proper orientation during assembly of the pieces 32 and 34 together, and by maintaining that orientation during the bonding operation. In this regard, it should be also appreciated that the embossed beads 48, 80 and tabs 52 can restrict relative movement between the header and tank pieces 32, 34 both in the longitudinal direction 20 and in directions transverse thereto, thereby enhancing the alignment of the header and tank pieces 32, 34 with each other, as well as the assembly and bonding of the manifold construction 10. In this regard it may be desirable in some application to utilize the embossed beads 48, 80 and tabs 52 when alignment of the pieces 32 and 34 is required even without a bonding operation.

What is claimed is:

1. An elongated manifold construction having a longitudinal axis for a heat exchanger having a plurality of tubes extending from the manifold construction, the manifold construction comprising:

an elongated tank piece including a pair of spaced longitudinally extending tank edges and a tank wall extending from one of the tank edges to the other to define a cross-sectional shape for the tank piece transverse to the longitudinal axis, the tank edges facing a common direction;

an elongated header piece including a pair of spaced longitudinally extending header-edges and a header wall extending from one of the header edges to the other to define a cross-sectional shape for the header piece transverse to the longitudinal axis, the header edges facing a direction opposite the common direction;

at least one of the tank and header pieces further including at least two embossed beads spaced along the longitudinal axis in the wall adjacent the edges of the at least one of the tank and header pieces, each embossed bead having a terminal end spaced from one of the edges of the at least one of the tank and header pieces and facing the other of the tank and header pieces, each of the terminal ends having an opening therein;

at least one of the tank and header pieces further including a plurality of tabs spaced along the longitudinal axis in each of the edges of the at least one of the tank and header pieces and extending toward the other of the tank and header pieces to engage in the opening in the terminal ends of the embossed beads.

2. The elongated manifold construction of claim 1 wherein the embossed beads are in the tank wall and the tabs are in the header edges.

3. The elongated manifold construction of claim 1 wherein the embossed beads are in the header wall and the tabs are in the tank edges.

4. The elongated manifold construction of claim 1 wherein at least one of the embossed beads comprises a pair of terminal ends, with one of the pair of terminal ends being the terminal end with the opening and the other of the pair of terminal ends located adjacent the same edge as the terminal end with the opening.

5. The elongated manifold construction of claim 4 wherein the other of the pair of terminal ends is free of any openings.

6. The elongated manifold construction of claim 1 wherein at least one of the embossed beads comprises a pair of terminal ends, with one of the pair of terminal ends located adjacent one of the edges of the at least one of the tank and header pieces and the other of the pair of terminal ends located adjacent the other of the edges of the at least one of the tank and header pieces, the at least one of the embossed beads extending across the wall from one of the pair of terminal ends to the other of the pair of terminal ends, each of the pair of terminal ends having one of the openings receiving one of the tabs.

7. The elongated manifold construction of claim 1 wherein at least one of the embossed beads protrudes outwardly into an exterior space surrounding the manifold construction.

8. The elongated manifold construction of claim 1 wherein at least one of the embossed beads protrudes into an interior volume of the manifold construction.

9. The elongated manifold construction of claim 1 wherein at least one of the tabs is located in a recess formed in one of the edges of the at least one of the tank and header pieces.

10. The elongated manifold construction of claim 1 wherein the cross-sectional shape of at least one of the header and tank pieces is U-shaped.

11. An elongated manifold construction having a longitudinal axis for a heat exchanger having a plurality of tubes extending from the manifold construction, the manifold construction comprising:

an elongated tank piece including a pair of spaced longitudinally extending tank edges and a tank wall extending from one of the tank edges to the other to define a cross-sectional shape for the tank piece transverse to the longitudinal axis, the tank edges facing a common direction, the tank piece further including at least two embossed beads in the tank wall spaced along the longitudinal axis adjacent the tank edges, each embossed bead having a terminal end spaced from one of the tank edges and facing the common direction, each of the terminal ends having an opening therein;

an elongated header piece having a pair of spaced longitudinally extending header edges and a header wall extending from one of the header edges to the other to define a cross-sectional shape for the header piece transverse to the longitudinal axis, the header edges facing a direction opposite the common direction, the header piece further including a plurality of tabs spaced along the longitudinal axis in each of the header edges and extending toward the tank piece to engage in the opening in the terminal ends of the embossed beads.

12. The elongated manifold construction of claim 11 wherein at least one of the embossed beads comprises a pair of terminal ends with one of the pair of terminal ends being the terminal end with the opening and the other of the pair of terminal ends located adjacent the same tank edge as the terminal end with the opening.

13. The elongated manifold construction of claim 12 wherein the other of the pair of terminal ends is free of any openings.

14. The elongated manifold construction of claim 11 wherein at least one of the embossed beads comprises a pair of terminal ends, with one of the pair of terminal ends located adjacent one of the tank edges and the other of the pair of terminal ends located adjacent the other tank edge, the at least one of the embossed extending across the wall from one of the pair of terminal ends to the other of the pair of terminal ends, each of the pair of terminal ends having one of the openings receiving one of the tabs.

15. The elongated manifold construction of claim 11 wherein at least one of the embossed beads protrudes outwardly into an exterior space surrounding the manifold construction.

16. The elongated manifold construction of claim 11 wherein at least one of the embossed beads protrudes into an interior volume of the manifold construction.

17. The elongated manifold construction of claim 11 wherein at least one of the tabs is located in a recess formed in one of the header edges.

18. The elongated manifold construction of claim 11 wherein the cross-sectional shape of at least one of the header and tank pieces is U-shaped.

19. The elongated manifold construction having a longitudinal axis for a heat exchanger having a plurality of tubes extending from the manifold construction, the manifold construction comprising:

an elongated tank piece including a pair of spaced longitudinally extending tank edges and a tank wall extending from one of the tank edges to the other to define a cross-sectional shape for the tank piece transverse to the longitudinal axis, the tank edges facing a common direction;

an elongated header piece having a pair of spaced longitudinally extending header edges and a header wall extending from one of the header edges to the other to define a cross-sectional shape for the header piece transverse to the longitudinal axis, the header edges facing a direction opposite the common direction;

the header piece further including at least two embossed beads in the header wall spaced along the longitudinal axis adjacent the header edges, each embossed bead having a terminal end spaced from one of the header edges and facing a direction opposite to the common direction, each of the terminal ends having an opening therein; and the tank piece further including a plurality of tabs spaced along the longitudinal axis in each of the tank edges and extending toward the header piece to engage in the opening in the terminal ends of the embossed beads.

20. The elongated manifold construction of claim 19 wherein at least one of the embossed beads comprises a pair of terminal ends with one of the pair of terminal ends being the terminal ends with the opening and the other of the pair of terminal ends located adjacent the same header edge as the terminal end with the opening.

21. The elongated manifold construction of claim 20 wherein the other of the pair of the terminal ends is free of any openings.

22. The elongated manifold construction of claim 19 wherein at least one of the embossed beads protrudes outwardly into an exterior space surrounding the manifold.

23. The elongated manifold construction of claim 19 wherein at least one of the embossed beads protrudes into an interior volume of the manifold construction.

24. The elongated manifold construction of claim 19 wherein at least one of the tabs is located in a recess formed in one of the tank edges.

25. The elongated manifold construction of claim 19 wherein the cross-sectional shape of at least one of the header and tank pieces is U-shaped.

26. The elongated manifold construction having a longitudinal axis for a heat exchanger having a plurality of parallel tubes extending from the manifold construction, the manifold construction comprising:

an elongated tank piece including a back wall and two tank side walls extending from each side of the back wall to define a U-shaped cross-section transverse to the longitudinal axis, the tank piece including at least two embossed beads spaced along the longitudinal axis, each embossed bead having a pair of terminal ends and extending across the back wall and partially down each of the tank side wall to each of the terminal ends, each of the terminal ends having an opening formed therein;

an elongated, header piece having a tube receiving wall and two header side walls extending from each side of the tube receiving wall to define a U-shaped cross-section transverse to the longitudinal axis, each of the header side walls having a plurality of the tabs spaced along the longitudinal axis and extending away from the tube receiving wall to engage in the opening in the tank piece.

27. The elongated manifold construction of claim 26 wherein at least one of the embossed beads protrudes outwardly into an exterior space surrounding the manifold construction.

28. The elongated manifold construction of claim 26 wherein at least one of the embossed beads protrude into an interior volume of the manifold construction.

29. The elongated manifold construction of claim 26 wherein at least one of the tabs is located in a recess formed in one of the header side walls.

* * * * *